United States Patent [19]

Kemmer et al.

[11] Patent Number: 5,074,089

[45] Date of Patent: Dec. 24, 1991

[54] SEALING DEVICE FOR FACADES AND/OR ROOFS

[75] Inventors: Wolfgang Kemmer, Würzburg, Fed. Rep. of Germany; Norbert Herwegh, Schattdorf, Switzerland

[73] Assignees: Mero-Raumstruktur GmbH & Co., Wurzburg, Fed. Rep. of Germany; Datwyler AG, Schweiz. Kabel-, Gummi- und Kunstoffwerke, Altdorf, Switzerland

[21] Appl. No.: 381,741

[22] PCT Filed: Aug. 31, 1988

[86] PCT No.: PCT/CH88/00151

§ 371 Date: Jun. 22, 1989

§ 102(e) Date: Jun. 22, 1989

[87] PCT Pub. No.: WO89/02016

PCT Pub. Date: Mar. 9, 1989

[30] Foreign Application Priority Data

Sep. 4, 1987 [CH] Switzerland ..... 3419/87

[51] Int. Cl.[5] ..... E04D 3/08

[52] U.S. Cl. ..... 52/395; 52/14; 52/461; 52/467; 52/468

[58] Field of Search ..... 52/467, 460, 461, 14, 52/15, 82, 235, 395, 468

[56] References Cited

U.S. PATENT DOCUMENTS 4,114,330 9/1978 Sukolics ..... 52/460
4,418,506 12/1983 Weber ..... 52/235

FOREIGN PATENT DOCUMENTS 191145 8/1986 European Pat. Off. ..... 52/235
0218969 11/1987 European Pat. Off. .
3419104 11/1985 Fed. Rep. of Germany ..... 52/235
2595109 9/1987 France .
1549279 7/1979 United Kingdom .

*Primary Examiner*—John E. Murtagh
*Attorney, Agent, or Firm*—Herbert Dubno

[57] ABSTRACT

The sealing device serves for tightly sealing the gap (6) between adjacent elements (1) of the inclined facade or roof against the access of water, by forming several sealing planes (A—A, B—B, C—C, D—D). To this effect a network of sealing pieces is created. These pieces each consist of a lower portion (21) and an upper one (22). The lower portion (21) also acts as a support for the elements and comprises a bearing surface (214) each between two sealing lips (212, 213). The upper portion (22) consists of a metal rail (22) and of a sealing stip (222) which overlaps the rail laterally and rest on the elements. That sealing strip which extends in the slope or direction of the fall comprises two substantially vertical webs (228). These webs form a drainage channel for water that may have penetrated, together with substantially parallel lateral sealing lips (224) which also seal the faces of the elements. Additional channels are formed between the sealing strips and the metal rail (220) extending in between them. The sealing pieces running transversely to the line of fall are of simpler design. Junctions of particular design on those locations where the sealing pieces of one kind intersect the others serve for maintaining these junctions absolutely tight, too.

8 Claims, 5 Drawing Sheets

SEALING DEVICE FOR FACADES AND/OR ROOFS

CROSS REFERENCE TO RELATED APPLICATIONS

This application is a National Phase of PCT/CH88/00151 filed Aug. 31, 1988 and based, in turn, on Swiss application 3419/87 of Sept. 4, 1987 under the International Convention.

Field of the Invention

The invention refers to a sealing device for sealing facades and/or roofs with or without a curvature in their length and width and presenting a fall, i.e. lying in a gradient, whereby they are assembled from numerous elements arranged side by side.

BACKGROUND OF THE INVENTION

In building constructions frequent use is made of prefabricated elements for the skin of the facades and roofs. However, these elements can fulfil their function only if the gaps between the elements are sealed in a manner that permits an easy mounting of the latter whereby the sealing must be durable and easily installed.

OBJECTS OF THE INVENTION

It is therefore an object of the invention to provide a sealing device with prefabricated elements assembled on site in form of a modular system without the necessity of additionally resorting to sealing compounds or bonding agents.

Still another object is to provide the sealing device that becomes nearly independent of meteorological conditions.

SUMMARY OF THE INVENTION

With prefabricated sealing elements, i.e. those made at the factory or workshop, it is not easy to achieve a perfect sealing because on the building site unpredictable tolerances always arise. The invention therefore provides an entire sealing device composed of several parts that complement each other in such a way that whenever a leak occurs in one part (which is mostly the case) another part take up the moisture seeped in and drain it. Besides draining the water, the present invention discloses air conduits coming from the outside and serving for compensating the pressure and for air exchange, so that the formation of condensed moisture between the facade or roof elements to be seated can be avoided.

Furthermore the sealing device should be designed in such a way that it is not only applicable for inclined planar facades or roofs but also can be used without any basic modification also constructions of at least single curvature such as barreled roofs, tunnel vaults and even an constructions of double curvature like hemispherical roofs as frequently used for exhibition pavillons and for the ends of the vaults mentioned above.

The sealing device according to the invention is composed of sealing pieces which are formed of interior or lower sealing portions having means for defining an inner sealing zone between the elements and the rooms of the building delimited by them, as well as by outer or upper portions having means for defining further sealing zones which are arranged one behind the other.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
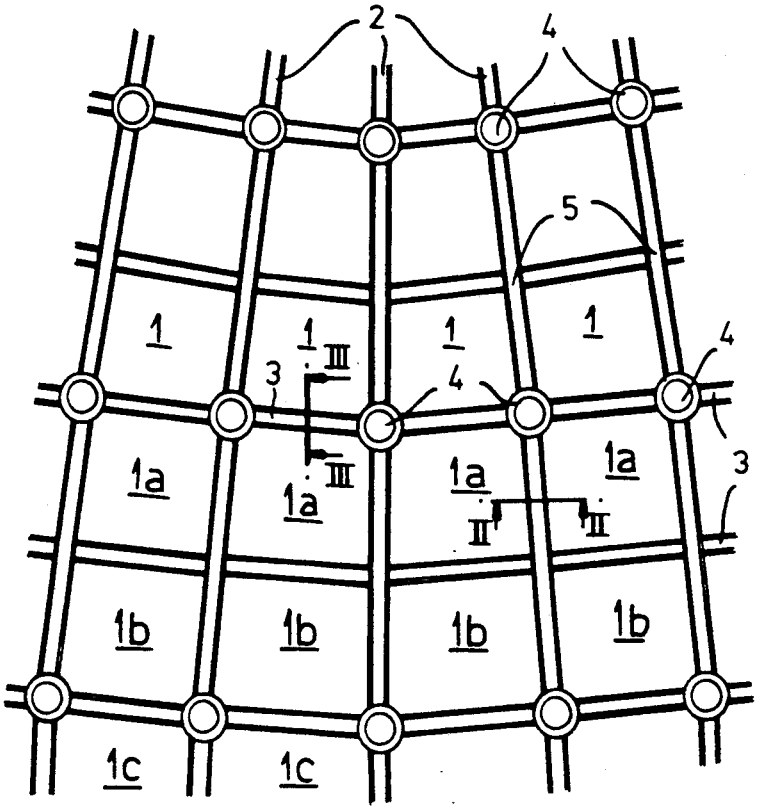
FIG. 1 is discloses a view of a cutout of a hemispherical roof on which the individual roof elements are sealed by the device, FIG. 2 a section through two adjacent construction elements with the sealing device lying in the fall along line II—II.

FIG. 1 shows a cutout of a roof which in its entity has a double curvature but is made up of individual planar elements 1, 1*a*, 1*b*, 1*c*. The roof construction as illustrated always has two roof elements 1*a*, 1*b* lying in one plane which, however, is at an angle with the planes of other elements, i.e. the adjacent elements 1*a*, 1*b*. This arrangement suggests a great number of elements having reasonable dimensions. The entire roof therefore is not exactly hemispherical. It might be conceivable to achieve this shape by forming each element so as to achieve an exactly hemispherical shape. However the primary intention is to provide the sealing device capable of sealing the gaps or joints of elements not located in the same plane. As will be shown a junction between four elements lying a common plane can be made different from a junction between elements not lying in the same plane.

Figure 2:
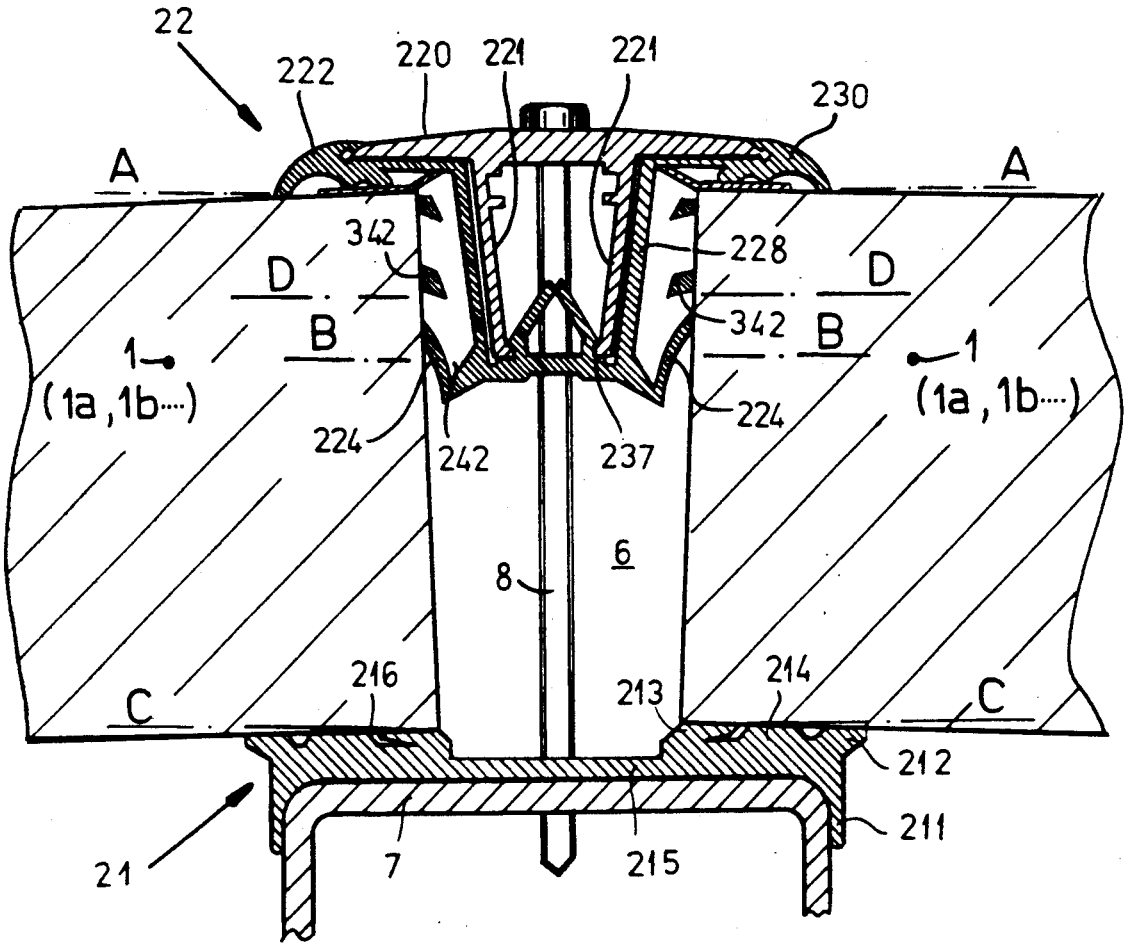
Figure 4:
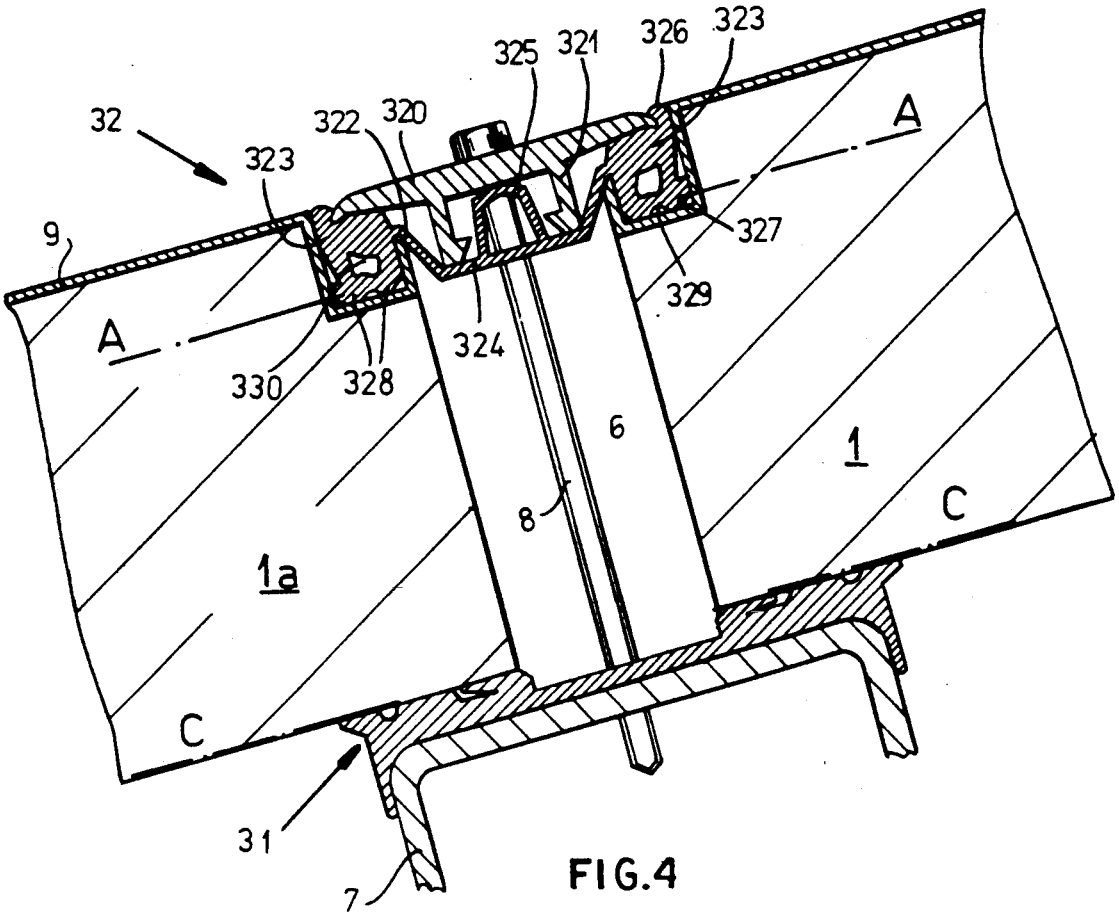
FIG. 4 is illustrates a section through two adjacent construction elements along line III—III according to FIG. 1, FIG. 5 an exploded prospective view of the sealing of a main junction, FIG. 6 a section in the direction of the slope according to line VI—VI in FIG. 5 whereby the parts are presented already in their fully mounted state.

In FIG. 1 only the upper visible parts of the sealing device are represented, the lower ones can be seen in FIGS. 2 and 4. The upper parts are composed of sealing pieces 2 extending along the line of fall (on a spherical body one may resort to them as meridional seals), sealing pieces 3 extending transversely or, in the present case, horizontally and thus running annularly, main junctions 4 and of secondary junctions 5. The last ones are only present if elements are aligned along a line of fall, i.e. when there is no break in the gradient of that line. Consequently, these secondary junctions are of an easier design than the main junctions 4 on which each one of the four elements may lie in a different plane.

FIG. 2 illustrates the sealing piece 2, i.e. one that extends in the line of fall. It is shown as disposed between two adjacent elements 1 or 1*a*, 1*b* etc., which are not located in the same plane. They are separated from each other by a gap 6 and are supported by a common roof support or, more generally, an element support 7. The sealing piece consists of a lower portion 21 and an upper portion 22 producing a sealing effect. Lower portion 21, so-called abutment, which consists of a strip made of elastic material, has two lateral flaps 211 extending downwards and enclosing an element support 7 on both sides, so that the abutment is centered, and maintained in its place. If required, bonding may be provided between abutment and support 7 in addition to the clamping effect. Abutment 21 is divided into two sealing areas, each one formed by sealing lips 212, 213, and into a bearing surface 214 located between the two lips. The sealing areas arranged symmetrically with regard to the center plane of the abutment are connected to each other by means of a bridge 215. Sealing lips 212, 213 are always directed away from the center plane towards the marginal sides of abutment 21. A wedge-shaped gap 216 of substantial depth, located between each sealing lip 213 and bearing surface 214, extends towards the center. By this arrangement sealing lip 213 becomes long and flexible so that it will abut the lower side of element 1, providing a good sealing effect. The sealing lips and bearing surface 214 together form a supporting zone.

It follows from the above that this abutment 21 has two functions, i.e. the one of sealing and the one of supporting. Each outer sealing lip 212 primarily serves for creating a seal between the element 1 and, support 7 so that, on one hand, no water can get through and on the other hand, no humid warm air formed in the interior of the building can enter the gap where its moisture would condense. This sealing lip 212 must be so flexible that it can adapt itself to the unevenness of the element as well as to the displacements of the gap due to wind pressures. In addition the lip also exerts, to some extent, a supporting function. Each one of the inner sealing lips 213 has a definite double function. It is required to produce the sealing effect but simultaneously, in its deformed state, to enlarge the supporting area (in its non-deformed state the lip extends obliquely in an upward direction). The lip must therefore enlarge bearing surface 214. This lip is particularly important on the so-called sandwich elements having a relatively soft core, reducing the marginal compressive loads and the danger of deformation. Therefore the two functions are equivalent in this case.

The upper portion 21 includes a metal rail 220 of generally rectangular cross-section with webs 221 and a sealing strip 222 pressed onto the elements **1, 1*a* by the rail 220. Metal rail 220 is fastened onto support 7 by means of bolts 8. Along its edges it is partly overlapped by sealing strip 222** so that no moisture can penetrate there.

Figure 3:
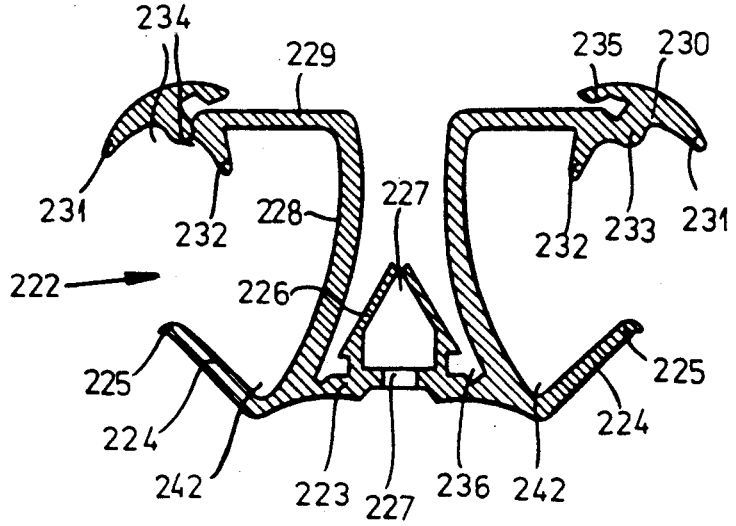
FIG. 3 is the sealing step element according to FIG. 2 in an enlarged scale.

FIG. 3 illustrates the cross-section of strip 222, before installation. The strip has a lower connecting bridge 223 with a respective sealing lip 224 formed on each end thereof and extending angularly upwards. Each Lip 224 has a tip 225 which extends at a small angle with regard to the lip itself so that tip 225 can sealingly abut against the faces of elements **1, 1*a*, as can be seen in FIG. 2. In the center of connecting bridge 223 a hollow body having the shape of a roof 226 extends upwardly. Its purpose will be explained later. The roof is provided, at certain distances, with two central openings 227, one above the other, for receiving a bolt 8. Between each sealing lip 224 and roof 226 a respective web 228 extends generally vertically upwards and is formed with a respective sealing zone 230 on its generally horizontally projecting flange 229. The lower side of that zone is defined by two sealing lips 231, 232 and a spacer 233 between them, forming two channels 234 between the spacer and each sealing lip. The upper curved side of sealing zone 230 is provided with a sealing flap 235 which extends over the edge of metal rail 220** providing a resistant sealing.

Having the structure as described several sealing planes or zones are created on this gradient. In FIG. 2 these zones are designated with A—A, B—B, C—C and D—D. The uppermost sealing zone A—A is formed by sealing zones 230 resting on the upper side of elements **1, 1*a*, in particular by its sealing lips 231, 232 and by spacer 233. Spacer 233 has two functions, a first one is the transmission of the compressive forces resulting from bolting down metal rail 220 onto support 7 acting on the upper part of the seal 21, the other one is keeping sealing zone 230 at a distance from element 1*a* in the zone of channels 234, so that the latter will not be fully compressed. These channels are important in view of possible relative displacements which may occur between the top side of elements 1, 1*a* and sealing zones 230 on account of temperature variations and wind pressure. In the course of time these displacements add up whereby it may not fully be excluded that dirt particles soiling the surface on the visible part of the elements may pass underneath the outer sealing lips 231, creating minor leaks in this manner. Water that may penetrate is drained downwards through outer channel 234 and is diverted towards the outside in the junction still to be described or towards the end of the facade or the roof. The inner sealing lip 232** forms an additional safety barrier against the influence of weather and dirt.

Sealing zone B—B is located in the area of the connecting bridge 223 and roof 226. If some water still may seep through the sealing means of zone A—A, it will now be received by this zone B—B. Water penetrates between the metal rail 220 and sealing strip 222 flows downwards between webs 221 and 228 into a groove 236. Water underneath the head of bolt 8, seeping downwards along its shank, is taken up in the area of roof 226. The openings 227, in particular, the one on top of the roof, are so narrow that the material of the roof and the bridge tightly abuts the shank or the thread. That water is directed by the roof 226 onto that location where roof 226 rests on the thickened ends 237 (FIG. 2) of webs 221. Already here a part of the water is drained in the direction of fall within the channel thus formed i.e. perpendicularly to the plane of projections. This is due to the fact that the sealing effect is already very great because webs 228, originally curved (FIG. 3), are straightened by webs 221 and therefore are tensioned and pressing roof 226 firmly against the thickened ends 237 of bridges 221. But even if there is still a leak, the remaining water can flow into grooves 236 already referred to. The third sealing zone, C—C, is formed by the lower portion or abutment 21 of the sealing piece 2. Particularities of this abutment have already been mentioned previously.

It is therefore essential that the entire sealing effect will be distributed over at least three sealing zones arranged in staggered relationship to each other. An additional sealing zone D—D is formed by sealing lips 224. Water that may flow down on the faces of elements **1, 1*a* will be directed over these lips 224 into channels 242 (FIG. 2) formed between lips and webs 228**.

As can be seen, the four sealing zones practically prevent any access of moisture into the gap 6, even during the most intensive precipitations, so that gap 6 remains dry. As already outlined above, gap 6 is not only protected against the ingress of water but also, due to abutment 21, from warm air that originates in the building and has a high humidity. Therefore there is no danger that the moisture can condense in the gap. The latter and the sealing material filled into it (not represented), mostly rock wool, thus remain dry even under the most adverse conditions. The fact must be remembered that this complete sealing is not achieved with parts that first need to be adapted on site in order to suit prevailing conditions, in particular deviations due to tolerances in the dimensions, but these parts are all prefabricated. They are made in such a manner that they can take up these tolerances. The sealing process on site therefore progresses rapidly, without any loss of a sealing effect.

The sealing pieces 3 running horizontally and represented in FIG. 4 and will now be explained. The sealing device shown in its mounted state, i.e. in an inclined position. The two elements with a gap 6 therebetween may converge towards the bottom. In FIG. 4 a change in the gradient of the fall is illustrated. Here, too, the entire sealing piece 3 consists of a lower portion 31 and an upper portion 32. A lower portion 31, the abutment, is fully identical to the abutment 21, therefore forms the same sealing zone C—C and needs no further explanation. An upper portion 32 consists of a metal rail 320 with webs 321 and of a sealing strip 322, the latter being of somewhat simpler design than the corresponding sealing strip 222 because it must conduct the water only to the nearest junction 4 or 5 where it is taken over by the fall sealings. The two webs 321 of the metal rail 320 are equipped with thickened ends. The sealing strip 322 is formed with two outer sealing bodies 323 and a bridge 324 connecting them, a roof-like body 325 seated onto this bridge in its center for creating a sealing zone A—A in analogy to the one on the sealing piece 2. This roof body 325, however, has a cross section different from the one of the roof 226 of sealing strip 222. Each sealing body has an upper sealing lip 326 and a lower sealing lip 327. The lower rim of each sealing body 323 is formed in such a way that it forms two rests 328 with a channel 329 therebetween. The junction between the trough-like bridge 324 and the sealing bodies lies on about half a height of the latter ones. The cavities 330 in the sealing bodies are adopted preimarily for receiving a saving material but also render them to be somewhat more elastic during their mounting. Here, too, the metal rail 320 is fastened onto the support 7 by means of bolts 8 passing through the upper portion 32 and the lower portion 31 and therefore presses the sealing strip 322 against elements 1, 1*a*, whereby the ends of webs 321 rest on the bridge 324. The bolts pass through openings 331 formed in the roof 325 and bridge 324.

The mounting of sealing strip 322 and its effect, however, differ from sealing strip 322. The two sealing bodies 323 are received each by a plate 9 having a U-shaped groove 91 and are hold by the latter. The plate 9 covers the entire upper side of each element 1, 1*a* etc. Here, too, relative displacements due to changes in temperature occur between metal rail 320 and sealing bodies 323 on which rail 320 rests, as well as a result of displacements between the sealing bodies and plates 9 so that in the extreme situation even sealing lips 326 can be deflected. However, if water can penetrate there, it will be taken up in the lower region of sealing bodies 323 because that region, due to its solid fixation in groove 91, does not move, and will be conducted to the nearest sealing piece 2.

The roof 325 has the same function as the roof 226 of the sealing piece 2, i.e. to divert water that may seep downwards along the shank of bolt 8 and to prevent its entering into gap 6.

Due to the trough-like shape, bridge 324 is able to compensate differences in the distances between elements 1 and 1*a* because the sidewalls of this trough can vary their gradient with regard to the horizontal part and because the latter may additionally be deflected if required.

In the following description the design of junctions 4 and 5 will be explained. It is, of course, essential that the sealing on these locations must be equally effective between elements 1, 1*a* etc. Forming various sealing zones therebetween. At the abutments 21, 31 the design of their points of intersection poses no problem: flaps 211, sealing lips 212, 213 and bearing surfaces 214 will be clongated until they meet each other, as a rule, at right angles. In the of the intersection there remains a level area, formed by the bridges 215 intersecting each other. It is appropriate to manufacture such an intersection as a separate piece and to connect it to the abutments 21, 31 by vulcanization.

The intersection of upper portions 22, 32 is somewhat more complicated. In addition the sealing problems are, to some extent, greater than the ones of the abutments because the upper portions are, of course, more exposed to the influence of weather. In addition, the fact that in the main junctions 4 these portions lie in different planes also should be considered.

Figure 6:
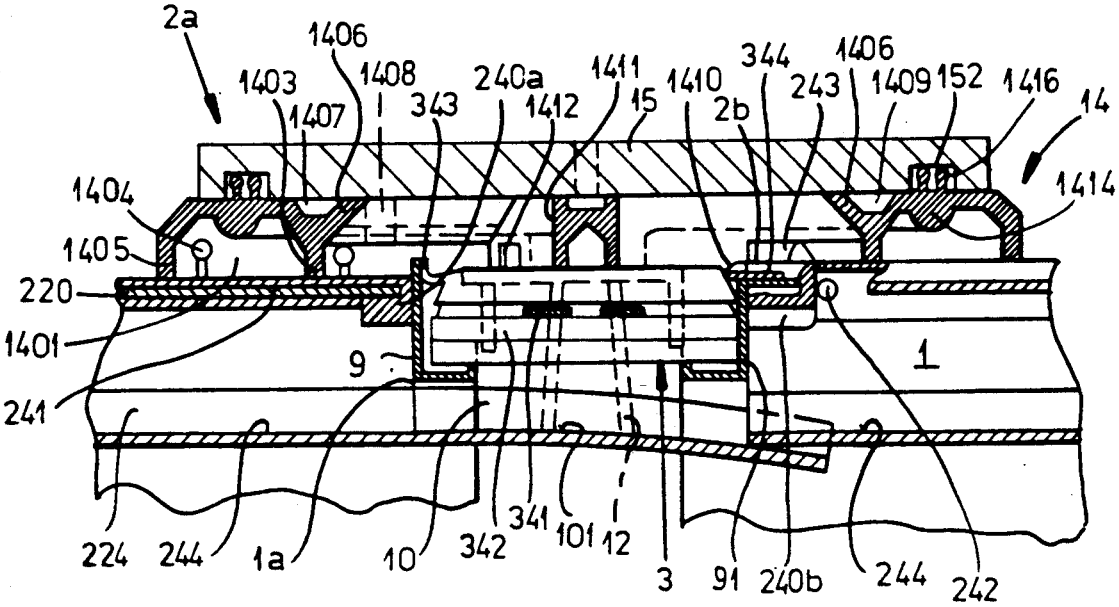
Figure 5:
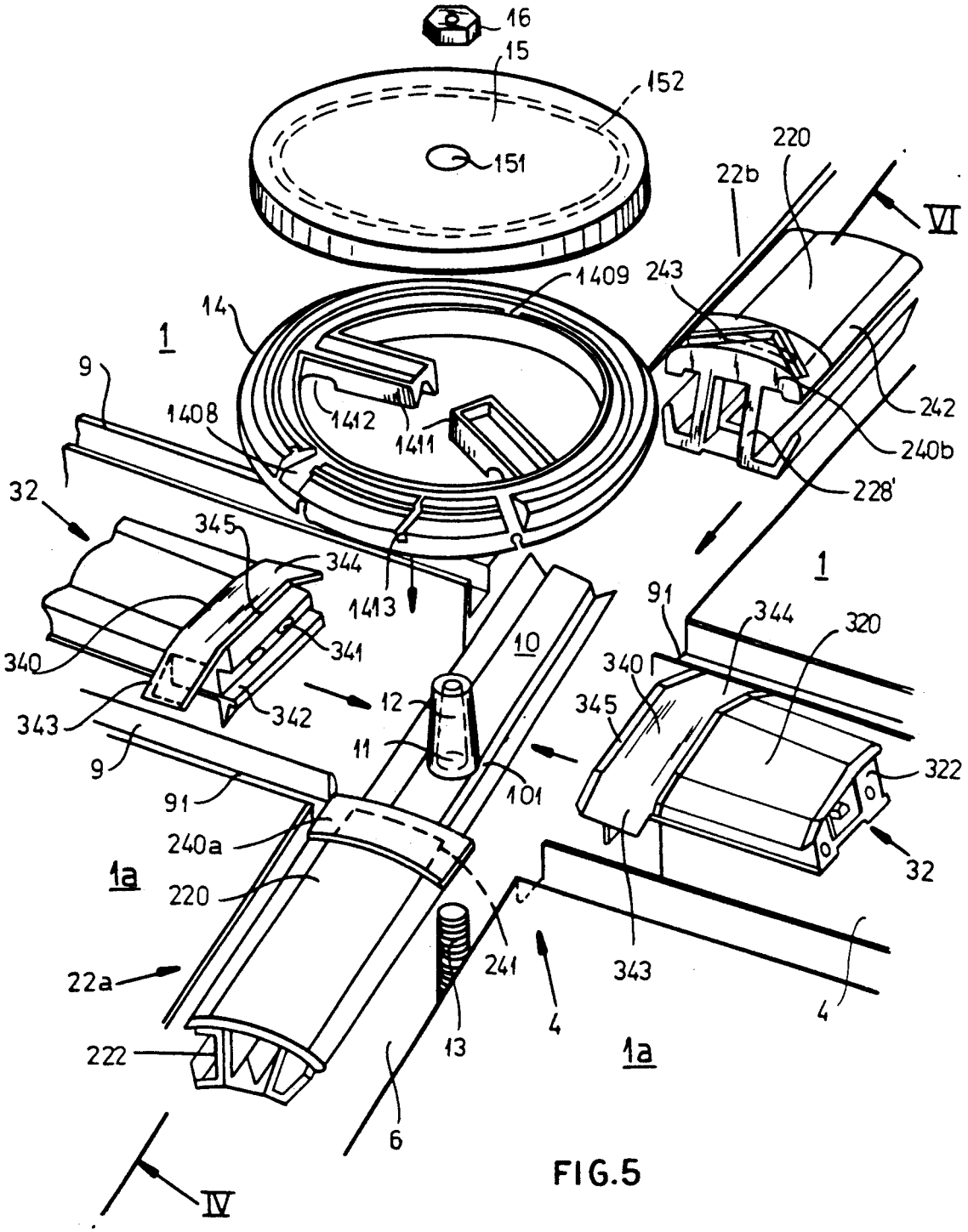
Figure 7:
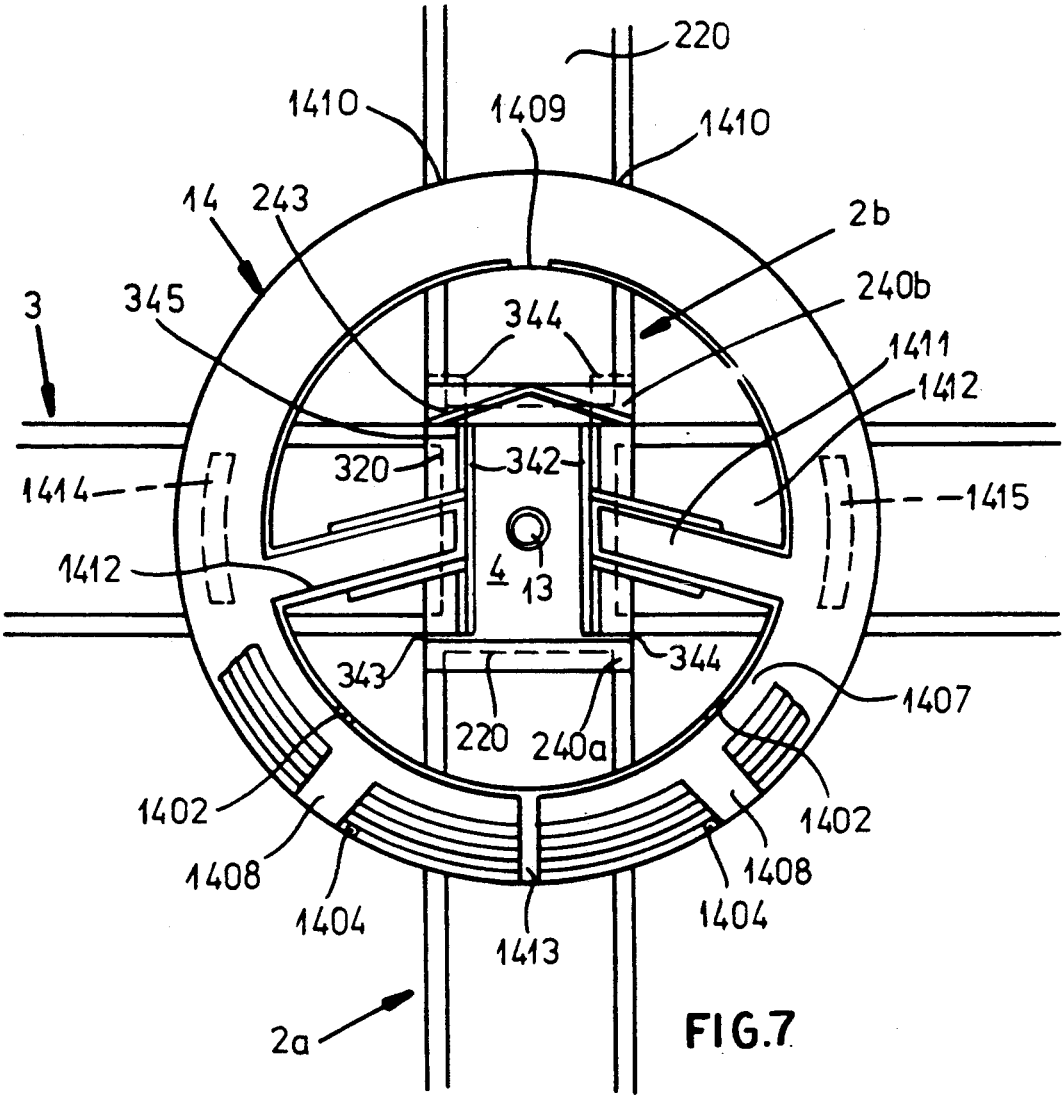
FIG. 7 is a top view of the main junction prior to mounting of the sealing disc.

FIGS. 5 to 7 illustrate the sealing on the main junctions 4. FIG. 5 shows the device in a prospective exploded view. For better viewing the four elements 1, 1*a* defining the junction are illustrated as being more distant from each other than in reality. The fall extends in this figure from the upper right to the lower left and shows a clearly visible break in its gradient. Only the part of the sealing piece at the lower left of the figure which therefore is the lower one and thus bears numeral 22*a* is already in its correct position with regard to the center of intersection. One can see details already referred to in connection with FIG. 2, i.e. metal rail 220 and sealing strip 222 covering it. Metal rail 220 terminates is inserted in an end piece 240*a* which provided with a slot 241 also shown in FIG. 6. End piece 240*a* generally has a cross section resembling the one of the sealing strip 222, but which, however, is simplified. End piece 240*b*, which according to FIG. 5 is connected with an upper portion 22*b* of a sealing piece at its lower end and has the cross section of this end piece. As can be seen from FIG. 5 sealing lips 224' and bridge 223' connect sealing elements 240*a* and 240*b* and bridge 223 connecting them are present. Differences between end pieces 240*a* and 240*b* exist also in a way their sealing areas are designed: the one of end piece 240*a* corresponds to the construction of FIG. 3 whereas the sealing areas of endpiece 240*b* are simplified and do not form channels 234 as illustrated in FIG. 3. These sealing areas of the end piece 240*b* therefore close channels 234 of sealing strips 222 of the upper portion 22*b* at their ends. In order to drain channels 234 nevertheless, a bore 242 is provided immediately above each end piece 240*b*. A further difference between the end pieces resides in piece 240*b* supporting two water deflectors 243 arranged in arrow-like fashion. The two end pieces are vulcanized to the sealing strips in such a way that drain channels 244 (FIG. 6) formed by sealing lips 224 and webs 228 (FIGS. 3 and 6) join each other without forming a shoulder in between. Webs 228' of the end pieces are substantially thicker than webs 228 of sealing strips 222 because webs 221 of rails 220 do not extend as far as the webs of the end pieces; webs 228 abut with their faces against webs 228'.

On the upper end of portion 22*a* of the lower sealing piece a flap 10 is vulcanized to end piece 240*a*. Its profile is substantially identical to the one of end piece 240*a* but lacks its upper parts. According to FIG. 3 it consists of sealing lips 224 and connecting bridge 223. In this manner drain channels 101 are formed which seamlessly connect to drain channels 244, as can be seen in FIG. 6. Flap 10 bridges the entire junction and extends far into the upper gap inclined in the direction of fall. In its center it carries a vertical upstanding tube section of a conical shape. This section serves for passing a threaded bolt 13 necessary for mounting all parts of the main junction, the bolt being is attached to a non-represented junction support. Bolt 13 is surrounded in a water-tight manner by this tubular section 12.

Endpieces 340 are also vulcanized to the respective end of the horizontal sealing pieces 3, i.e. those pieces which extend transversely to the line of fall respectively to their sealing strips 322. The shape of these endpieces can be seen the at left side of FIG. 5. One recognizes two passages 341 for water which may be collected on the bottom of the scaling strip 322 on both sides of roof 325. Below these passages or openings there is a drip ledge 242 which protrudes so far that water flowing over it will drip at any rate into the channels 101 of flap 10. These drip ledges are shown in FIG. 2 in their proper position with regard to channels 244 joining channels 101. Sealing flaps protruding to a considerable extent are also important. Due to the inclined position of the endpiece, one of these flaps shall be designated as a lower sealing flap 343 and the other one as an upper sealing flap 344. Their importance of operating as sealing elements will be explained later. Finally a rim 345 is to be mentioned and is visible in FIG. 5 extending over the entire end piece 340 including its sealing flaps on the face thereof and raising towards that face. Due to the slope of this rim the latter is able to conduct water away from the face onto the endpiece itself so that this water flows over the upper side of elements 1, 1*a* and does not enter the interior of the junction.

Sealing pieces 2*a*, 3 and 2*b* will be mounted one after another. During mounting of pieces 3 lower sealing lips 343 come into contact with endpiece 240*a* and will be bent upwards as can ce seen clearly in FIG. 6. Water flowing over them will therefore be diverted in FIG. 6 towards the viewer, i.e. away from the center, draining accross elements 1*a*.

Upper sealing lips 344, however, come to rest with their ends on top of upper elements 1 and additionally are pressed against them by endpiece 240*b* which is mounted on top of the lips. Whatever water may be on the end pieces is therefore prevented from entering the cavity between the four elements but will be diverted by these sealing lips 344. That part of the water that does not reach channels 101, will flow across metal rails 320.

This overlap, known on house building from the arrangement of the roofing tiles or on older houses from their shingles, is consequently applied also on mounting the last sealing piece 2*b*. FIG. 6 shows how its sealing strip comes to rest on the free end of flap 10 which, in turn, is only partially supported by the filling material in the gap, preferably rock wool (not shown). One may see how water also on the lowermost part of sealing piece 2*b*, i.e. on drain channels 244 previously referred to, flows into channels 101 of flap 10 without having a chance of dripping through a gap into the innermost area of the junction.

After all sealing pieces 2*a*, 3 and 2*b* have been inserted, an elastic sealing ring 14 is placed in the center and covered with a sealing disc 15. Sealing disc 15 has a bore, so that it can be fastened by means of a nut 16 set onto the end of threaded bolt 13 and will press elastic ring 14 down onto the sealing pieces and particularly onto elements 1, 1*a* situated in four different planes. Ring 14 serves primarily for guiding that water around the junction which precipitates onto the upper elements and sealing piece 2*b* whereas the sealing disc has to protect the center of the junction which, without the disc, is still open, against direct precipitations. The aeration of this center, the so-called vapour pressure equalization, is taken care of by the ring 14 formed appropriately to that effect.

A cross-section of the ring 14 can be seen in FIG. 6, its shape and its various characteristics from FIGS. 5 and 7. The cross-section resembles somewhat one half of a hexagon cut through its center, the section line coinciding with the bearing surface of ring 14. In this manner an annular draining cavity 1401 (FIG. 6) is formed. It receives precipitations from the ring center through narrow slots 1402 which have a round head opening and are disposed at both sides of the lowermost spot of ring 14 mounted in place (FIG. 7). Cavity 1401 is drained again by slots 1404 of identical form which are located on outer wall 1405 of ring 14 but angularly closer together than slots 1402. The slots are so narrow so as to enable the water to drain slowly from the cavity and to reduce a possible inlet of precipitations into cavity 1401 to a minimum during a stormy weather with its wind gusts. This is why slots 1402 and 1404 are not coaxial.

To that side of the hexagon which faces its central space a second conical inner ring 1406 (FIG. 6) is connected so that a dip is created which forms an annular aeration channel 1407. This channel is represented only in part in FIG. 7, for better viewing. It has two inlets 1408 to the outside of ring 14, on about the same locations as slots 1402 and 1404, as well as a passage 1409 on that location of inner ring 1406 which is highest when ring 14 is mounted. This passage 1409 which is located nearly diametrically opposite inlets 1408, leads to the center of the junction. Through this channel 1407 the pressure in the interior of the junction is adjusted to the exterior pressure. Inlets 1408 are larger than slots 1402 because they are located at a higher level than the bearing surface of ring 14 and the upper side of elements 1, 1*a* with the water damming up there. On strong rains and winds water may pass in drops through these inlets and thus into the aeration channel 1407 but cannot reach the passage 1409 because channel the 1407 provides the only access to the interior of the junction and because the passage 1409 is not only spaced from the inlets but it is also located at a higher level. Therefore the admission of air to the center of the junction and with it the pressure equalization are ensured, while the admission of water is rendered impossible.

As shown in FIG. 6, inlets 1408 are arranged on the upper inclined part of the wall 1403.

FIG. 6 further discloses that upper sealing piece 28 often lies somewhat higher than adjacent elements 1, 1*a*. The upper side of the metal rail 220 and of the end piece 240 are therefore at a higher level than the surface of these elements. Thus water may enter on locations 1410

(FIGS. 6 and 7), following sealing strips 222 and eventually reaching the area encircled by ring 14. From there it flows onto sealing pieces 3. Still the possibility remains that water may enter the unprotected center of the junction. In order to avoid this, ring 14 bears two water deflectors 1411 which extend radially from its inner ring 1406 towards the center. However, they are not located on the same diameter but form an angle with each other. They extend, as can be seen in FIG. 7, up to the faces of end pieces 340. Water that has penetrated first flows along their upper sides radially towards the outside and then can reach slots 1402 by passing a bridge-like passage 1412, to be recognized especially from FIG. 6, and by following inner wall 1403. Through these slots it enters a draining cavity 1401, leaving it again through slots 1404. In this manner a complete drainage is ensured here.

Since the aeration channel 1407 is provided with two separate inlets 1408 in order to drain water penetrated across the upper side of the elements and not across the sealing pieces, a slot 1413 is provided at the lowest point of channel 1407 which drains that lowermost area. Due to the extremely small volume of water to be drained it can be kept small.

The draining cavity 1401 is limited at its highest point by a bead 1414 which in the area of sealing pieces 3 functions as a pressure rim 1415. These rims press onto the sealing pieces since they extend down to the bearing surface of the ring 14 (FIG. 6) ensuring that the surfaces of the sealing pieces do not lie at a higher level than the surfaces of the elements located above them.

On its summit the ring 14 bears a pair of sealing lips 1416 (FIG. 6). The disk 15 is provided with a corresponding groove 152 into which these lips fit. These lips extend around entire ring 14.

Figure 8:
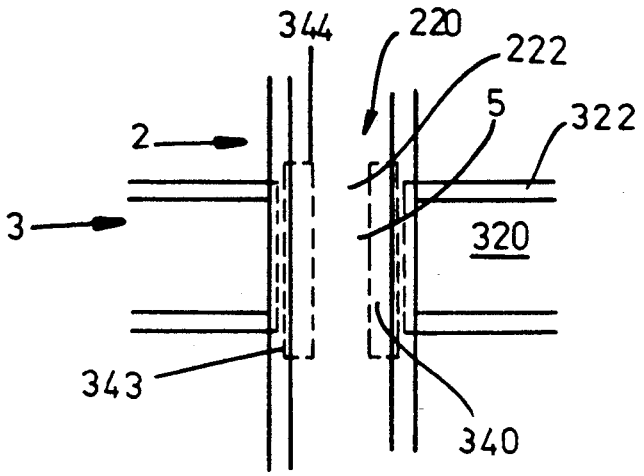
FIG. 8 is a top view of a secondary junction in a reduced scale.

Secondary junctions 5 according to FIG. 8 can be done with a simple sealing. Since there are no changes in the gradient between elements 1 and 1*a*, sealing piece 2 extending in fall direction can pass across junction 5, together with its rigid metal rail 220. Sealing strip 222 overlies sealing pieces 3, which are laterally adjacent. This structure provides a nearly complete sealing because sealing pieces 3 with their end pieces 340 and sealing flaps 343, 344 lie underneath sealing strip 222. Water collected in the channels 329 below sealing bodies 323 (FIG. 4) can drain into channels 242 of sealing pieces 2.

The sealing device as illustrated and described permits a perfect sealing of even large roofs, whether they are barreled, simple or double curved and which due to their size must be constructed from individual elements. Since it is impossible on such extensive sealings to connect sealing strips 222, 322 as well as lower portions 21, 31 to a network on a manufacturing plant, they are made in certain lengths. These individual sections are then mechanically connected to each other by vulcanizing flaps onto their ends, similarly to flap 10 but of minor length. Some of the flaps bear protrusions on their upper surface in the form of dovetailed anchorages well known in a machine design whereas the other flaps which come to rest upon them have corresponding cutouts. These connections permit the bridging of certain tolerances during erection of the roof because the elastic sealing strips and portions may easily be tensioned to some extent either under tensile or compressive stress.

We claim:

1. A roofs or facade assembly comprising:

a plurality of supports each formed with a respective outer side;

a respective inner sealing strip on the outer side;

a pair of prefabricated individual surface-forming elements on said inner strip arranged edge to edge forming a gap to be sealed therebetween, each said of surface-forming elements being formed with a respective outer surface and an inner surface, the inner strip extending between the surface-forming elements and being in contact with said inner surfaces;

a one-piece outer strip spaced from the inner strip and formed with:

a pair of side walls tapering inwardly into the gap to be sealed, a respective strip flange extending laterally outwardly from each of the side walls and overlapping and contacting the outer surface of the respective surface-forming element adjacent the gap, a web in the gap bridging the side walls and forming a compartment therewith, and a respective inner lip on each of opposite edges of the web extending angularly outwardly towards and pressing against the respective edge of the pair of the ace-forming elements;

a metal rail extending into said compartment and said gap and formed with:

a pair of spaced apart rail flanges respective ones of the strip flanges and a pair of inwardly tapering legs extending into the compartment and connected with the respective rail flanges, the rail and the outer strip forming an outer seal for the gap; and a fastening bolt engaging the support and the rail and urging the inner and outer strips against the respective inner and outer surfaces of the surface-forming elements with the inner lips sealably pressed against the respective edges thereof upon tightening of the bolt and so that said elements can assume a variety of angles between them while being sealed at said gap.

2. The assembly defined in claim 1 wherein the support has an inverted U-shaped cross section, the inner strip being formed with a pair of spaced apart flanks abutting side walls of the support.

3. The assembly defined in claim 1 wherein the rail flanges are connected by a continuous bridge side of the rail, the legs of the rail being abutted by the side walls of the outer strip between the bridge side and the web of the outer strip.

4. The assembly defined in claim 1 wherein each of the strip flanges is formed with a respective undercut portion formed between a pair of ribs extending inwardly and being in contact with the outer surface of the respective surface-forming element, the web of the outer strip being provided with a hollow body thereon having generally a triangular cross section and formed with aligned openings provided at an apex of the hollow body and in the web receiving the bolt.

5. The assembly defined in claim 1 wherein the respective side walls and the web of the outer strip form a first drainage channel therebetween.

6. The assembly defined in 5, further comprising:

another support extending at a right angle to the first-mentioned support;

another inner strip on the other support;

another pair of surface-forming elements arranged edge to edge and delimiting another gap therebetween, each of the elements of the other pair being formed with a respective outer surface formed with a respective recess open in the other gap; and another outer seal formed with:

a respective strip having a web in the other gap and provided with a pair of the outwardly diverging inner lips extending toward the respective edges of the other pair of surface-forming elements, each of the pair of the inner lips of the other outer seal running into a respective sealing body received by the respective recess, and another metal rail pressing against the sealing bodies.

7. The assembly defined in claim 6 wherein four of said outer strips are juxtaposed in a respective junction at a corner of the surface-forming elements and provided with respective end pieces, said end pieces being covered by a ring, one of the end pieces being formed with a flap extending across the cavity and being in a contact with the opposite end piece, the flap being formed with a pair of second drainage channels formed between a bottom side and a respective pair of side channel walls of the channel extending angularly outwardly therefrom and being in contact with respective channels formed between the respective inner lips and side walls of the outer strip of the opposite sealing element and with means for receiving the ring.

8. The assembly defined in claim 7 wherein said ring is an elastic ring provided with a sealing disk pressing the ring against the end pieces, the ring including:

an inner circumferential drainage cavity formed between inner and outer circumferential walls of the ring, a endless channel formed in the inner wall of the ring and covered by the sealing disk, the channel being provided with a pair of inlets for communicating between the channel and the exterior and with a channel spaced angularly from the inlets and leading to the interior of the ring, the inner and outer walls of the ring being provided with respective openings formed at level lower than a level of a bottom of the channel, a pair of water deflectors extending radially inward and at an angle with respect one another toward a center of the ring, each of the deflectors being provided with a respective passage having generally an inverted U-shaped cross section and communicating with the openings formed on the inner wall of the ring for directing a water from the interior to the drainage cavity.

* * * * *